US006382293B1

(12) United States Patent
Brockington et al.

(10) Patent No.: US 6,382,293 B1
(45) Date of Patent: May 7, 2002

(54) AWNING TENSION ASSEMBLY AND METHOD

(75) Inventors: William T. Brockington, Kernersville, NC (US); Gary L. Carnes, San Jose, CA (US)

(73) Assignee: Camco Manufacturing, Inc., Greensboro, NC (US)

( * ) Notice: Subject to any disclaimer, the term of this patent is extended or adjusted under 35 U.S.C. 154(b) by 0 days.

(21) Appl. No.: 09/739,604

(22) Filed: Dec. 19, 2000

(51) Int. Cl.[7] ..... E04F 10/06

(52) U.S. Cl. ..... 160/67; 160/46; 160/65; 160/68

(58) Field of Search ..... 160/64, 65, 66, 160/67, 68, 70, 71, 80, 72, 69; 135/88.11, 88.12; 248/499

(56) References Cited

U.S. PATENT DOCUMENTS 3,263,735 A 8/1966 Vecchiarelli et al.
3,327,724 A 6/1967 Nielsen
4,244,670 A * 1/1981 Pidcock ..... 410/103
4,567,628 A * 2/1986 Prete, Jr. et al. ..... 24/68 CD
4,598,847 A 7/1986 Ames, III
4,640,332 A 2/1987 Turner
4,842,236 A * 6/1989 Yonts ..... 248/499
4,842,458 A * 6/1989 Carpenter ..... 410/3
5,171,056 A 12/1992 Faludy et al.
5,246,052 A 9/1993 Homan
5,873,400 A * 2/1999 Faller ..... 160/67

* cited by examiner

*Primary Examiner*—Bruce A. Lev

(57) ABSTRACT

An awning tension assembly and method allows the awning of a recreational vehicle to be secured during storms and gusty winds. The assembly is affixed to the ends of fluted awning roll bars and includes a clip which fits within a roll bar flute for securement. The assembly can be installed and adjusted to provide the requisite tension required and can be easily removed when no longer needed.

17 Claims, 6 Drawing Sheets

AWNING TENSION ASSEMBLY AND METHOD

FIELD OF THE INVENTION

The invention herein pertains to awnings which are affixed to mobile homes, recreational vehicles, motor homes and particularly pertains to an assembly for stabilizing the awning when in an extended posture.

DESCRIPTION OF THE PRIOR ART AND OBJECTIVES OF THE INVENTION

Recreation vehicle owners are continually concerned with the extension and retraction of side awnings which are used as protective coverings while the RV is parked, for example, at a campsite. Harsh rainstorms, windstorms and other inclement weather can damage or destroy such awnings which often have to be repaired or replaced at great cost. Frequently, awnings are left extended during foul weather conditions, only to have a relatively light storm turn suddenly violent, without the RV owner being available or otherwise able to retain the awning.

Various remedies have been offered in the past to prevent awning damage while it remains extended. For example, U.S. Pat. No. 5,246,052 provided a quick disconnect device which will help stabilize the awnings in violent, windy conditions. Nevertheless, there has remained a need for a device which will apply tension to the awning roll bar to keep it firmly in an extended posture and which will be suitable in either the "carport" or patio configuration.

Thus, based on the problems of prior awning restraints and the needs of consumers, the present invention was conceived and one of its objectives is to provide an awning tension assembly and method which allows for easy and convenient attachment to an RV awning.

It is yet another objective of the present invention to provide an awning tension assembly and method which can be easily adjusted and used either in the usual "patio" or "carport" modes.

It is still another objective of the present invention to provide an awning tension assembly which includes a coil spring with a flexible nylon strap and release mechanism for adjusting the length of the nylon strap, a clip for placement in flutes on the awning roll bar and a buckle for tightening the assembly on the roll bar.

It is a further objective of the present invention to provide an U-shaped, metal roll bar clip which releasably engages the buckle.

Various other objectives and advantages of the present invention will become apparent to those skilled in the art as a more detailed description is set forth below.

SUMMARY OF THE INVENTION

The aforesaid and other objectives are realized by providing an awning tension assembly which includes a clip attached at one end of a flexible strap. The clip is somewhat U-shaped with a projection for placement in one of the flutes of a typical awning roll bar. The clip is configured to form a loop with the buckle and strap which securely contains the roll bar as the clip engages the slidable buckle on the flexible strap in a noose-like fashion. By shortening the strap length, the roll bar is placed under greater tension. A coil spring affixed at the opposite end of the flexible strap is releasably joined to, for example, the foot of an awning arm which may be attached to the side of the RV or to the ground, depending on the particular awning configuration desired. By attaching the spring to the foot, the tension assembly is conveniently anchored and does not depend on stakes or supplemental fasteners. The method of use allows engagement of the roll bar clip to the fluted roll bar. Adjusting the strap length with the release mechanism applies pressure to the roll bar to tension the awning fabric.

DETAILED DESCRIPTION OF THE PREFERRED EMBODIMENT AND OPERATION OF THE INVENTION

Figure 1:
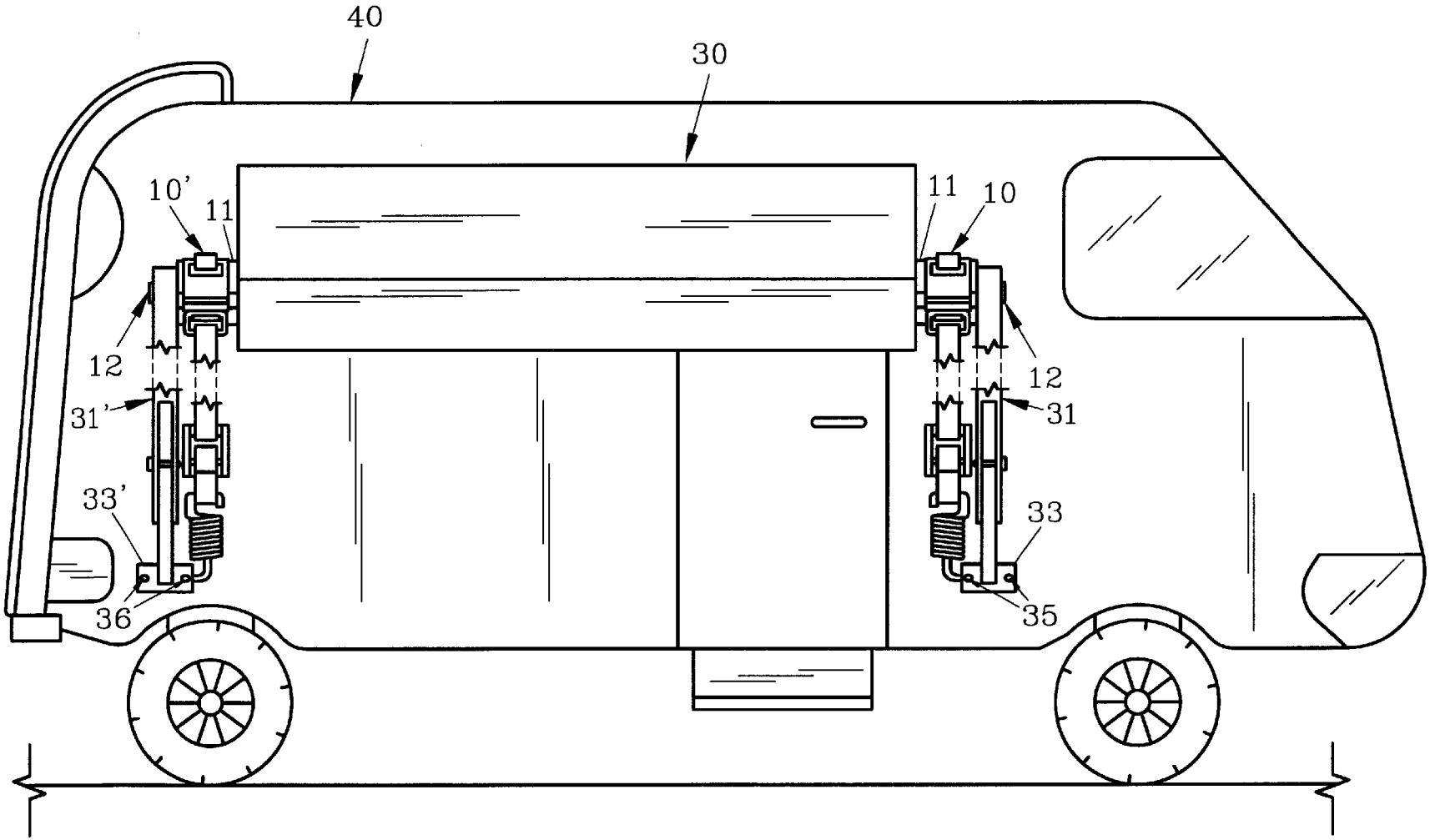
FIG. 1 illustrates a conventional RV with the awning extended in a patio configuration and the awning tension assembly of the present invention in place.
Figure 2:
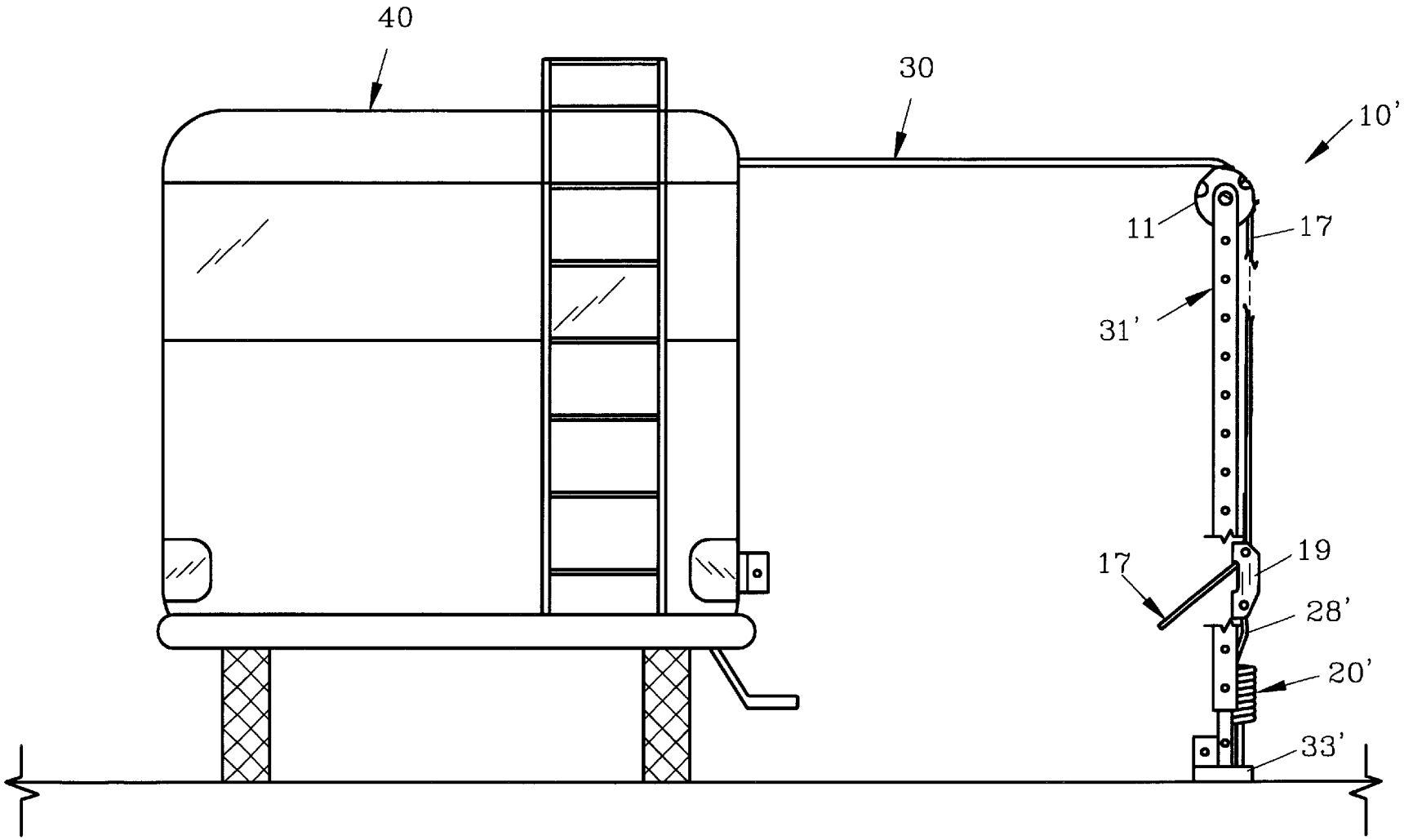
FIG. 2 shows a rear view of the RV and awning as seen in FIG. 1 but with the awning in t he carport configuration.

For a better understanding of the invention and its method of operation, turning now to the drawings, FIG. 1 illustrates the preferred form of the invention as illustrated by awning tension assemblies 10, 10' for retaining awning 30 in a fully extended, tensioned posture. As would be understood, awning 30 is affixed to typical RV 40 in a conventional manner to allow it to extend in either a biased, patio position as shown in FIG. 1 or in a somewhat more horizontal or carport position as shown in FIG. 2. In FIG. 1, awning tension assembly 10 is affixed at one end to standard fluted roll bar 11 (shown enlarged in FIG. 3) with center axle 12. As further shown, roll bar 11 as seen in FIG. 3 includes a trio of grooves or flutes 13 although other commercially available roll bars may have more or less flutes therearound.

Figure 3:
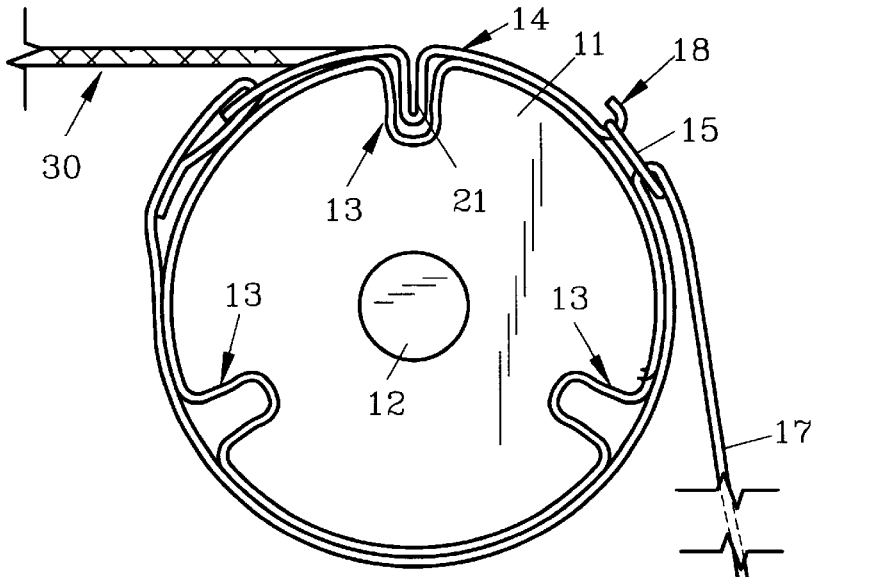
FIG. 3 demonstrates an enlarged view of the awning assembly removed from the RV but attached to a fluted roll bar.
Figure 6:
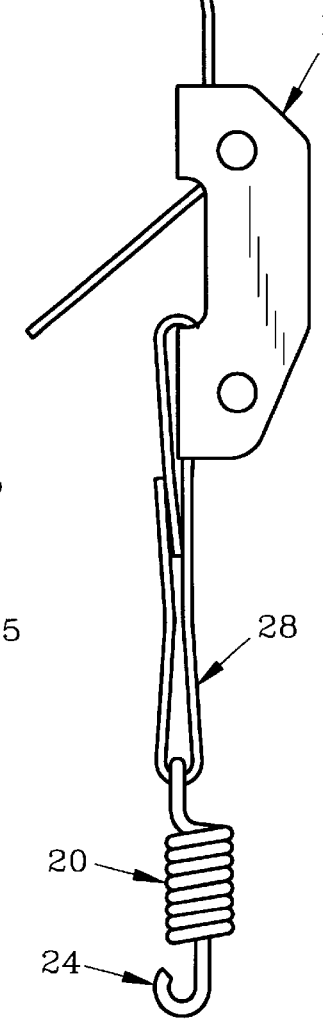
FIG. 6 depicts a side view of the awning clip as seen in FIG. 5.
Figure 6:
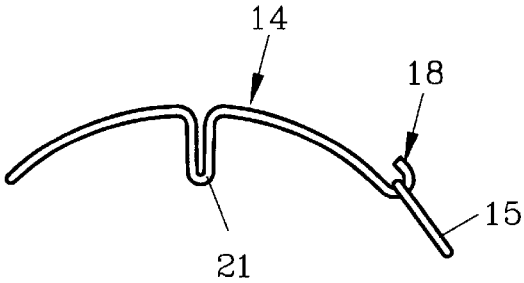
Figure 7:
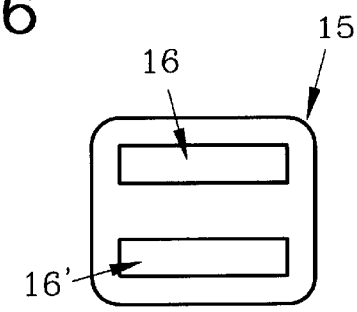
FIG. 7 features a top enlarged view of the buckle as seen in FIG. 3 removed from the flexible strap.
Figure 4:
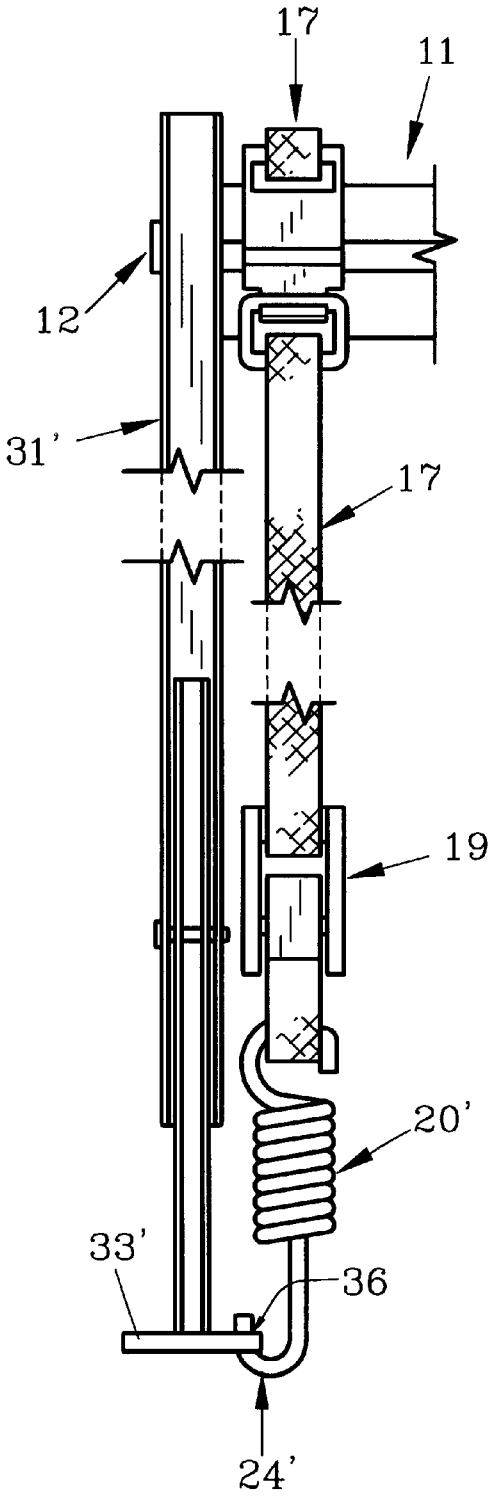
FIG. 4 pictures the awning assembly of the invention as affixed to the fluted roll bar and awning arms.
Figure 8:
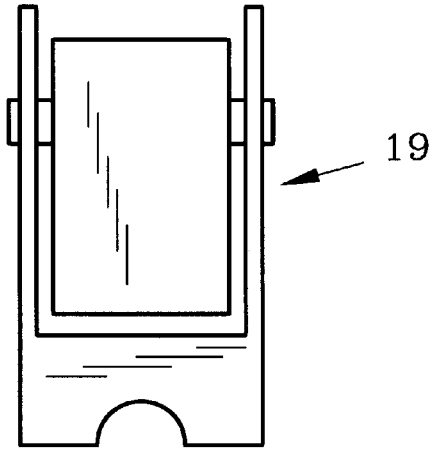
FIG. 8 pictures a top view of the release mechanism as shown in FIG. 3.
Figure 10:
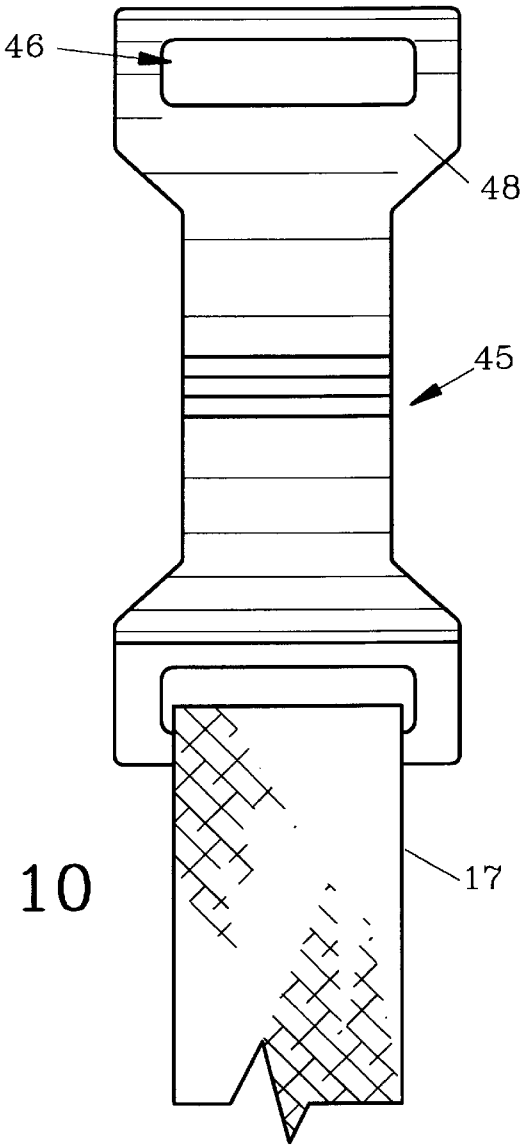
FIG. 10 shows an enlarged view of an alternate roll bar clip without a hook.
Figure 11:
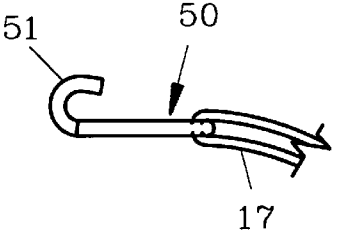
FIG. 11 depicts a smaller side view of another buckle embodiment having a hook.
Figure 13:
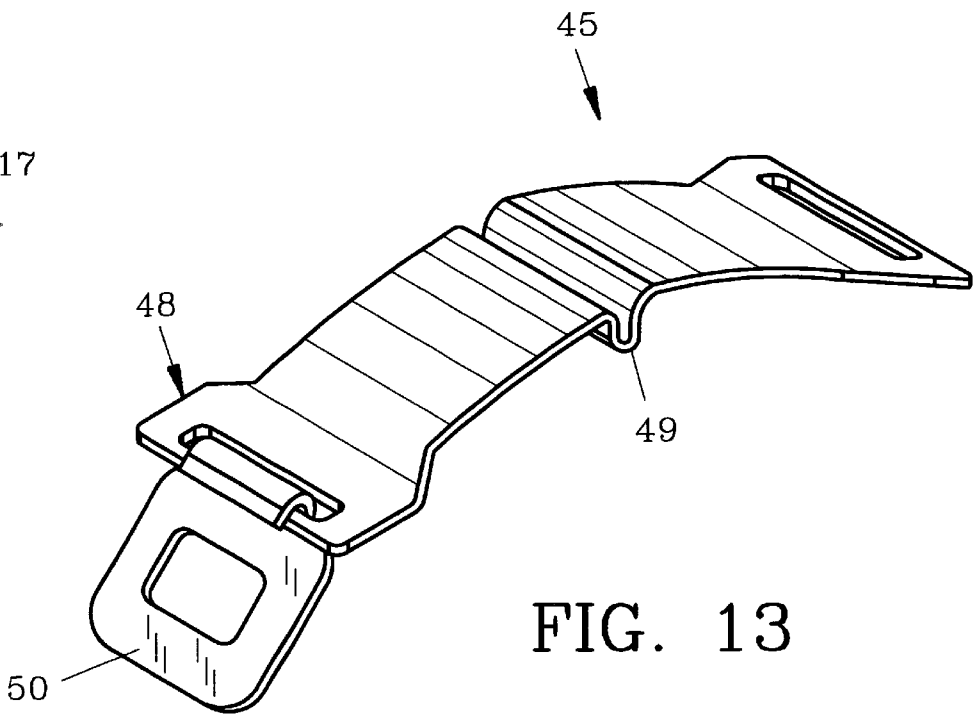
FIG. 13 demonstrates an enlarged perspective view of the clip as seen in FIGS. 10 and 12 joined to the buckle as seen in FIG. 11.
Figure 12:
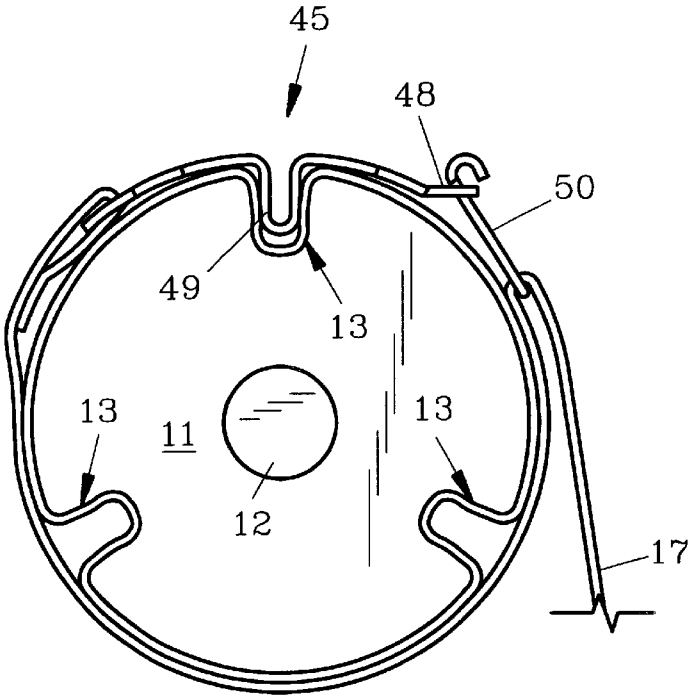
FIG. 12 illustrates the roll bar clip of FIG. 10 shown on the awning roll bar.

Preferred tension assembly 10 includes a substantially inverted U-shaped metal clip 14 which, when seated in flute 13 as shown in FIG. 3 is engageable with buckle is (seen enlarged in FIG. 7). Clip 14 includes a first end and a second end with defined projection 21 spaced therebetween. Strap 17 is permanently affixed to the first end of clip 14 as seen in FIG. 3 and releasably engages the other or second end of clip 14 through buckle 15. Buckle 15 includes a pair of rectangular openings 16, 16' for engagement of flexible nylon strap 17 and hook 18 of roll bar clip 14 (shown removed from awning roll bar 11 in Fig. 6) Strap 17 may be approximately 2.5 cm wide as required and may be 2–4 meters in length. Conventional strap release mechanism 19 also shown in FIGS. 3 and 8 allows the user to manually tighten strap 17 against anchor spring 20 (apply pressure) positioned in foot 33' when affixed as shown in FIG. 4. In FIG. 3, flexible band 28 connects release mechanism 19 to spring 20.

Figure 9:
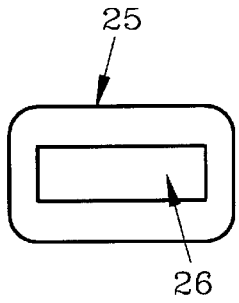
FIG. 9 provides an alternate buckle to that seen in FIG. 7.

An alternate strap buckle 25 is shown in FIG. 9 having a larger, single opening 26 to accommodate hook 18 of roll bar clip 14 and strap 17.

Figure 5:
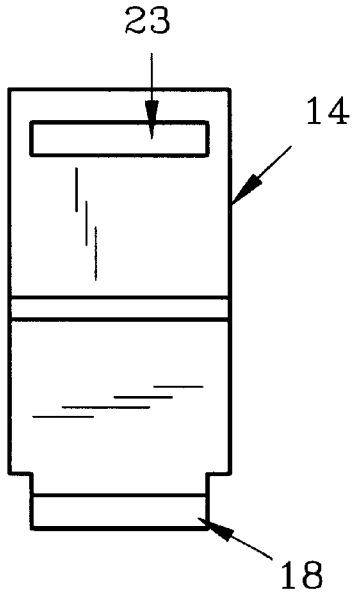
FIG. 5 shows one embodiment of the awning clip as removed from the flexible strap.

In use, adjustable awning arms 31, 31' as shown in FIG. 1 are affixed to axle 12 of awning roll bar 11. Awning arms 31, 31' are attached to axle 12 on either end of fluted awning roll bar 11 and can be anchored to the RV as shown in FIG. 1 in patio fashion or extended to allow the awning to form a "carport" as shown in FIG. 2. Anchor springs 20, 20' (FIGS. 3 and 4) are inserted through holes 35, 36 in feet 33, 33' of adjustable awning arms 31, 31'. Awning tension assemblies 10, 10' are affixed to awning roll bar 11 by manually placing projection 21 of U-shaped clip 14 into one of flutes 13 of roll bar 11. Next, strap 17 which passes through opening 23 in the first end (FIG. 5) of U-shaped clip 14 is then wrapped around roll bar 11 to allow preferred buckle 15 to engage hook 18 at the second or opposite end of clip 14 through opening 16. Spring hook 24 is then placed in opening 36 in foot 33'. Next, release mechanism 19 is manipulated to tighten strap 17 which passes first through buckle opening 16' and on to release mechanism 19. Thereafter, in the event of a storm or other violent inclement weather conditions, awning 30 can be safely maintained in an extended posture without fear of being blown or torn from the RV.

The preferred method of use includes the steps of placing inverted U-shaped roll bar clip 14 on fluted awning roll bar 11 with projection 21 in a flute 13, placing strap 17 around roll bar 11 to allow buckle 25 to engage roll bar clip 45, attaching the end of the strap opposite U-shaped roll bar clip 45 at a remote distance from roll bar 11 such as with spring 20 positioned in foot 33 and adjusting the length of strap 17 to the release mechanism to apply pressure to roll bar 11.

Various changes and modifications can be made to the invention as described herein by those skilled in the art and the illustrations and examples provided herein are for explanatory purposes and are not intended to limit the scope of the appended claims.

We claim:

1. An awning tension assembly for a fluted awning roll bar comprising: a strap, a roll bar clip, said roll bar clip attached to said strap, said roll bar clip having a substantially inverted U-shape when positioned on said roll bar, a projection, said projection formed on said clip, said projection spaced from the ends of said U-shaped clip, one end of said clip permanently joined to said strap and the other end of said clip releasably joined to said strap, said projection for engagement with a flute on said roll bar whereby said clip and said strap encircle said awning roll bar to stabilize said clip thereagainst.

2. The awning tension assembly of claim 1 further comprising a buckle, said buckle slidably positioned on said strap for engagement with said roll bar clip.

3. The awning tension assembly of claim 1 further comprising a strap release mechanism, said strap release mechanism adjustably affixed to said strap.

4. The awning tension assembly of claim 3 further comprising an anchor spring, said anchor spring joined to said strap release mechanism.

5. The awning tension assembly of claim 1 wherein said clip further defines a hook at the end of said clip opposite said permanent strap connection, said hook for engaging said strap.

6. The awning tension assembly of claim 1 wherein said clip comprises a biased tab, said biased tab positioned on the end of said clip opposite said permanent strap connection for engaging said strap surrounding said fluted roll bar.

7. A method of applying tension to a fluted awning roll bar with a tension assembly having an adjustable strap permanently affixed to a first end of a U-shaped roll bar clip, said clip defining a projection spaced from said first end and a second end thereof, and a buckle slidably affixed to the adjustable strap and a release mechanism and an anchor spring at a distal end of the adjustable strap, comprising the steps of:

a) placing the U-shaped roll bar clip projection in a flute of the awning roll bar;

b) placing the strap affixed to the clip substantially around the roll bar to allow the buckle on the strap to releasably engage said second end of the roll bar clip;

c) attaching the end of the strap opposite the U-shaped roll bar clip at a remote distance from the roll bar; and d) adjusting the strap length with the release mechanism to apply pressure to the roll bar.

8. The method of claim 7 further comprising the step of removing tension from the fluted roll bar by manipulating the release mechanism.

9. The method of claim 7 further comprising the step of adjusting the strap.

10. The method of claim 9 further comprising the step of removing the tension assembly from the fluted roll bar.

11. An awning tension assembly for a fluted roll bar comprising: a flexible strap, a roll bar clip, said roll bar clip having a pair of ends, one of said clip ends defining a strap opening, a projection, said projection positioned on said clip and spaced from both ends thereof, one end of said strap positioned through said strap opening, a buckle, said buckle slidably attached to said strap, said buckle comprising a hook, said hook engaging said end of said clip opposite said strap opening whereby said strap can encircle said roll bar and apply tension thereto as said clip projection engages a flute on said roll bar.

12. The awning tension assembly of claim 11 wherein said strap is formed of nylon.

13. The awning tension assembly of claim 11 wherein said roll bar clip has a somewhat inverted U-shape.

14. The awning tension assembly of claim 11 wherein said clip includes a tab, said tab defining an opening.

15. The awning tension assembly of claim 11 further comprising a coil spring, said coil spring attached to said flexible strap.

16. An awning tension assembly in combination with a fluted awning roll bar having depending arms at each end, each arm having a foot, said assembly comprising: a strap, a roll bar clip having a pair of ends, a projection, said projection positioned on said roll bar and spaced between said ends thereof, said roll bar clip being fixedly attached to said strap at one end thereof and releasably attached at the opposite end thereof, said clip for engaging a flute on said awning roll bar, a spring, said spring attached to said strap and to one of said feet to apply tension to said strap.

17. The awning tension combination of claim 16 wherein said foot defines an opening, said spring positioned in said foot opening.

* * * * *